US010584614B2

(12) United States Patent
Auciello et al.

(10) Patent No.: US 10,584,614 B2
(45) Date of Patent: Mar. 10, 2020

(54) WASTE HEAT RECOVERY SIMPLE CYCLE SYSTEM AND METHOD

(71) Applicant: Nuovo Pignone Tecnologie Srl, Florence (IT)

(72) Inventors: Jury Auciello, Florence (IT); Paolo Del Turco, Florence (IT); Simone Amidei, Florence (IT)

(73) Assignee: NUOVO PIGNONE SRL, Florence (IT)

( * ) Notice: Subject to any disclaimer, the term of this patent is extended or adjusted under 35 U.S.C. 154(b) by 0 days.

(21) Appl. No.: 15/738,139

(22) PCT Filed: Jun. 23, 2016

(86) PCT No.: PCT/EP2016/064554
§ 371 (c)(1),
(2) Date: Dec. 20, 2017

(87) PCT Pub. No.: WO2016/207289
PCT Pub. Date: Dec. 29, 2016

(65) Prior Publication Data

US 2018/0313232 A1 Nov. 1, 2018

(30) Foreign Application Priority Data

Jun. 25, 2015 (IT) ..... 102015000027831

(51) Int. Cl.
*F01K 7/02* (2006.01)
*F01K 23/10* (2006.01)
(Continued)

(52) U.S. Cl.
CPC ..... *F01K 7/02* (2013.01); *F01K 13/02* (2013.01); *F01K 15/00* (2013.01); *F01K 23/10* (2013.01); *F01K 25/103* (2013.01); *F04B 35/00* (2013.01)

(58) Field of Classification Search
CPC ..... F01K 7/02; F01K 23/10; F01K 25/103; F01K 15/00; F04B 35/00
See application file for complete search history.

(56) References Cited

U.S. PATENT DOCUMENTS 3,234,735 A * 2/1966 Sage ..... F01K 23/067 60/39.181
3,971,211 A 7/1976 Wethe et al.
(Continued)

FOREIGN PATENT DOCUMENTS

DE 10 2011 108 970 A1 1/2013

OTHER PUBLICATIONS

Search Report and Written Opinion issued in connection with corresponding IT Application No. 102015000027831 dated Feb. 18, 2016.

(Continued)

*Primary Examiner* — Mark A Laurenzi
*Assistant Examiner* — Shafiq Mian
(74) *Attorney, Agent, or Firm* — Baker Hughes Patent Organization

(57) ABSTRACT

The power system comprises a working fluid circuit having a high pressure side and a low pressure side and configured to flow a working fluid therethrough. The working fluid circuit further comprises a heater configured to circulate the working fluid in heat exchange relationship with a hot fluid to vaporize the working fluid. The system further comprises serially arranged first expander and second expander fluidly coupled to the working fluid circuit and disposed between the high pressure side and the low pressure side thereof. One of the expanders drives a load and the other expander drives a pump or compressor fluidly coupled to the working fluid circuit between the low pressure side and the high pressure side thereof. A cooler is further arranged and configured to (Continued)

remove heat from the working fluid in the low pressure side of the working fluid circuit.

13 Claims, 2 Drawing Sheets

(51) Int. Cl.

| | |
|---|---|
| ***F01K 25/10*** | (2006.01) |
| ***F01K 13/02*** | (2006.01) |
| ***F01K 15/00*** | (2006.01) |
| ***F04B 35/00*** | (2006.01) |

(56) References Cited

U.S. PATENT DOCUMENTS

| | | | | |
|---|---|---|---|---|
| 8,616,001 | B2 * | 12/2013 | Held | F01K 13/02 60/646 |
| 8,783,034 | B2 * | 7/2014 | Held | F01K 25/10 60/651 |
| 9,341,084 | B2 * | 5/2016 | Xie | F01K 7/32 |
| 9,568,473 | B2 * | 2/2017 | Walker | A61K 39/0233 |
| 9,926,814 | B2 * | 3/2018 | Roh | F02C 1/08 |
| 10,103,737 | B2 * | 10/2018 | Fetvedt | H03L 5/02 |
| 2011/0072818 | A1 * | 3/2011 | Cook | F01K 13/02 60/645 |
| 2013/0033044 | A1 | 2/2013 | Wright et al. | |
| 2014/0102098 | A1 | 4/2014 | Bowan et al. | |
| 2014/0102101 | A1 * | 4/2014 | Xie | F01K 25/103 60/647 |
| 2014/0373542 | A1 * | 12/2014 | Yanagi | F01K 23/10 60/651 |
| 2015/0069758 | A1 | 3/2015 | Davidson et al. | |
| 2015/0076831 | A1 * | 3/2015 | Giegel | F01K 25/08 290/1 R |

OTHER PUBLICATIONS

International Search Report and Written Opinion issued in connection with corresponding PCT Application No. PCT/EP2016/064554 dated Aug. 9, 2017.

International Preliminary Report on Patentability issued in connection with corresponding PCT Application No. PCT/EP2016/064554 dated Dec. 26, 2017.

* cited by examiner

WASTE HEAT RECOVERY SIMPLE CYCLE SYSTEM AND METHOD

FIELD OF THE INVENTION

The present disclosure relates to power conversion systems. Some embodiments disclosed herein concern power conversion systems using a low-temperature thermodynamic cycle, such as a Rankine cycle or a Brayton cycle, to recover waste heat from a top, high-temperature thermodynamic cycle.

BACKGROUND OF THE INVENTION

Waste heat is often produced as a byproduct of industrial processes, where heat from flowing streams of high-temperature fluids must be removed.

Typical industrial processes which produce waste heat are gas turbines for mechanical drive as well as power generation applications, gas engines and combustors. These processes typically release exhaust combustion gases into the atmosphere at temperatures considerably higher than the ambient temperature. The exhaust gas contains waste heat that can be usefully exploited, e.g. to produce additional mechanical power in a bottom, low-temperature thermodynamic cycle. The waste heat of the exhaust gas provides thermal energy to the bottom, low-temperature thermodynamic cycle, wherein a fluid performs cyclic thermodynamic transformations, exchanging heat at a lower temperature with the environment.

Waste heat can be converted into useful power by a variety of heat engine systems that employ thermodynamic cycles, such as steam Rankine cycles, organic Rankine or Brayton cycles, $CO_2$ cycles or other power cycles. Rankine, Brayton and similar thermodynamic cycles are typically steam-based processes that recover and utilize waste heat to generate steam/vapor for driving a turbine, a turboexpander or the like. The pressure and thermal energy of the steam or vapor is partly converted into mechanical energy in the turboexpander, turbine or other power-converting machine and finally used to drive load, such as an electric generator, a pump, a compressor or other driven device or machinery.

Conversion of waste heat into useful mechanical power can substantially improve the overall efficiency of the power conversion system, contributing to the reduction of fuel consumption and reducing the environmental impact of the power conversion process.

Therefore, high-efficiency methods and systems for transforming thermal power into useful mechanical or electrical power are desirable.

SUMMARY OF THE INVENTION

Embodiments of the disclosure generally provide a power system comprising a working fluid circuit having a high pressure side and a low pressure side and configured to flow a working fluid therethrough. The power system can further comprise a heater configured to circulate the working fluid in heat exchange relationship with a hot fluid to vaporize the working fluid. In some embodiments, the power system also comprises serially arranged first expander and second expander fluidly coupled to the working fluid circuit and disposed between the high pressure side and the low pressure side thereof, configured to expand working fluid flowing therethrough and generating mechanical power therewith. A driveshaft can be drivingly coupled to one of the first expander and second expander, and configured to drive a load, such as a turbomachine or an electric generator, with mechanical power produced by said expander.

In embodiments described herein, a pump or a compressor is fluidly coupled to the working fluid circuit between the low pressure side and the high pressure side thereof, configured to rise the pressure of the working fluid in the working fluid circuit, and is drivingly coupled to the other of said first expander and second expander, i.e. the one not drivingly connected to the load, and is powered thereby. Thus, the serially arranged first and second expanders are used to selectively drive a pump or compressor, for rising the working fluid pressure, and a load. Part of the power developed by expanding the working fluid in one expander drives the pump or compressor, and part of the power, developed by expanding the working fluid in the other expander, produces useful power.

The power system can further comprise a cooler fluidly coupled to and in thermal communication with the low pressure side of the working fluid circuit and arranged and configured to remove heat from the working fluid in the low pressure side of the working fluid circuit.

According to embodiments disclosed herein, the system can further comprise a regulating valve arranged in the working fluid circuit, between the first expander and the second expander. The regulating valve is configured to adjust a back pressure of the first expander, i.e. to set the value of an intermediate pressure between the first expander and the second expander, such as to adjust the pressure drop of the working fluid across the first and second expanders.

According to some embodiments, a bypass valve can be arranged in parallel to one of the first expander and second expander. More in particular, a bypass valve can be arranged in parallel to the expander which is drivingly connected to the load. If insufficient waste heat is available, the expander can thus be bypassed and the available pressure drop between the high pressure side and low pressure side of the circuit is then used to drive the pump or compressor.

According to a further aspect, disclosed herein is a method for producing useful power from heat provided by a heat source, in particular for instance a waste heat source, comprising the following steps: circulating a working fluid flow by means of a pump or compressor through a working fluid circuit having a high pressure side and a low pressure side, wherein the high pressure side is in heat exchange relationship with the heat source and the low pressure side is in heat exchange relationship with a cooler; transferring thermal energy from the heat source to the working fluid; expanding the working fluid flow through a first expander from a high pressure to an intermediate pressure, converting a first pressure drop to mechanical power, and expanding the working fluid flow through a second expander from the intermediate pressure to a low pressure, converting a second pressure drop to mechanical power; wherein the first expander and the second expander are arranged in series to one another and fluidly coupled to the working fluid circuit, between the high pressure side and the low pressure side; removing residual, low-temperature heat from the working fluid flow through the cooler; driving a driven device with mechanical power generated by one of the first expander and second expander and driving the pump or compressor with mechanical power generated by the other of said first expander and second expander.

Features and embodiments are disclosed here below and are further set forth in the appended claims, which form an integral part of the present description. The above brief description sets forth features of the various embodiments of the present invention in order that the detailed description that follows may be better understood and in order that the present contributions to the art may be better appreciated. There are, of course, other features of the invention that will be described hereinafter and which will be set forth in the appended claims. In this respect, before explaining several embodiments of the invention in details, it is understood that the various embodiments of the invention are not limited in their application to the details of the construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which the disclosure is based, may readily be utilized as a basis for designing other structures, methods, and/or systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

A more complete appreciation of the disclosed embodiments of the invention and many of the attendant advantages thereof will be readily obtained as the same becomes better understood by reference to the following detailed description when considered in connection with the accompanying drawings, wherein.

DETAILED DESCRIPTION OF THE INVENTION

The following detailed description of the exemplary embodiments refers to the accompanying drawings. The same reference numbers in different drawings identify the same or similar elements. Additionally, the drawings are not necessarily drawn to scale. Also, the following detailed description does not limit the invention. Instead, the scope of the invention is defined by the appended claims.

Reference throughout the specification to "one embodiment" or "an embodiment" or "some embodiments" means that the particular feature, structure or characteristic described in connection with an embodiment is included in at least one embodiment of the subject matter disclosed. Thus, the appearance of the phrase "in one embodiment" or "in an embodiment" or "in some embodiments" in various places throughout the specification is not necessarily referring to the same embodiment(s). Further, the particular features, structures or characteristics may be combined in any suitable manner in one or more embodiments.

In the following disclosure of exemplary embodiments reference is made to a combined hybrid thermodynamic cycle, including a top, high-temperature thermodynamic cycle, the low-temperature source whereof provides waste heat to a bottom, low-temperature thermodynamic cycle. It shall, however, be understood that according to other embodiments, the power conversion system disclosed herein can be used to exploit heat power at relatively low temperatures from other heat sources, e.g. waste heat from other industrial processes, such as geothermal processes.

The conversion system is configured such that mechanical power generated by two expanders arranged in series between the high-pressure side and the low-pressure side of a, working fluid circuit generate mechanical power to directly drive a pump or compressor to increase the working fluid pressure from the low pressure to the high pressure of the thermodynamic cycle. One of the expanders generates mechanical power for the pump or compressor, while the other generates additional mechanical power to drive a load, such as an operating machine, e.g., a gas compressor, or an electric generator to convert mechanical power into electric power. Under steady state conditions, the working fluid flows through the first expander and the second expander arranged in series. A valve between the first expander and the second expander can be provided to control the power balance between the first expander and the second expander, as will be described in greater detail herein after.

Figure 1:
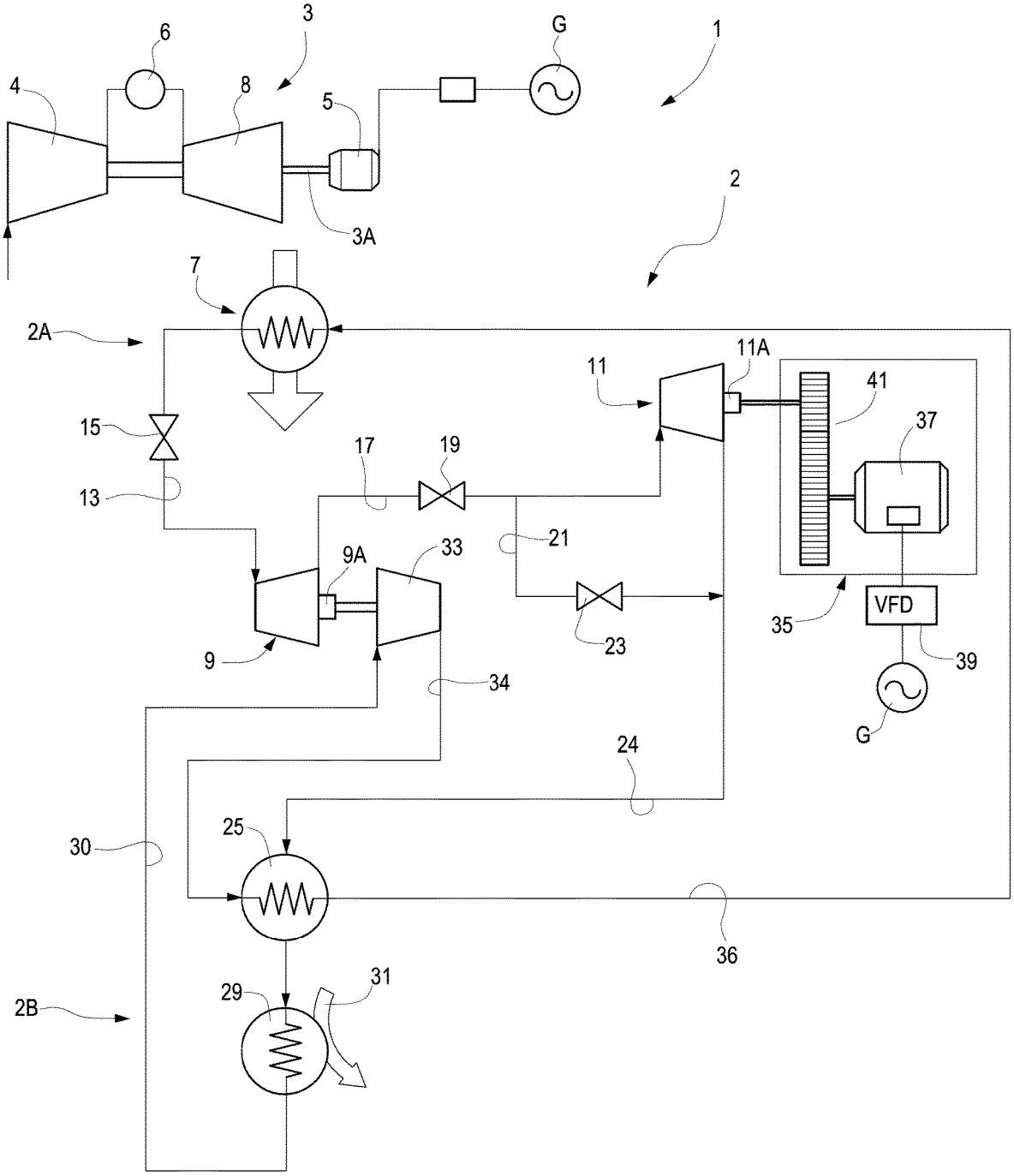
FIG. 1 illustrates a schematic of an embodiment of a waste heat recovery system according to the present disclosure.

FIG. 1 schematically illustrates a combined power conversion system including a top, high-temperature thermodynamic system 1 and a bottom, low-temperature thermodynamic system 2. The top, high-temperature thermodynamic system can be comprised of a gas turbine engine 3 and an electric generator 5 driven by mechanical power generated by the gas turbine engine 3 and available on the output driveshaft 3A of the latter. The gas turbine engine 3 can comprise a compressor section 3, a combustor section 6 and a turbine section 8.

The bottom, low-temperature thermodynamic system 2 comprises a working fluid circuit with a high pressure side 2A and a low pressure side 2B. The high pressure side includes a waste heat recovery exchanger 7, which is in heat exchange relationship with the exhaust combustion gas flow from the gas turbine engine 1. Heat can be exchanged directly in the waste heat recovery heat exchanger 7, from the exhaust combustion gas to the working fluid that circulates in the circuit of the bottom, low-temperature thermodynamic system 2. In other embodiments, an intermediate heat transfer loop can be provided, wherein a heat transfer fluid, such as diathermic oil or the like, circulates to transfer heat from a first heat exchanger, in heat exchanging relationship with the exhaust combustion gas flow, to the waste heat recovery exchanger.

In some embodiments the working fluid circulating in the bottom, low-temperature thermodynamic system 2 can be carbon dioxide ($CO_2$). The thermodynamic cycle performed by the working fluid can be a supercritical cycle, i.e. the working fluid can be in a supercritical state in at least a portion of the thermodynamic system.

In exemplary embodiments disclosed herein, between the high pressure side 2A and the low pressure side 2B of the circuit of the low-temperature thermodynamic system 2 a first expander 9 and a second expander 11 are arranged. One, the other or both expanders 9, 11 can be a single-stage or a multi-stage expander. For instance the expanders 9, 11 can be integrally-geared, multi-stage expanders.

The first expander 9 and the second expander 11 are arranged in series, such that working fluid flows from the waste heat recovery exchanger 7 through the first expander 9 and expands from a first pressure to an intermediate pressure, and at least part of the working fluid at the intermediate pressure from the first expander 9 flows through the second expander 11 and expands therein from the intermediate pressure to a second pressure.

In FIG. 1 the first expander 9 is connected to the output of the waste heat recovery exchanger 7 through a line 13 and a first valve 15. A line 17 connects the first expander 9 to the second, downstream expander 11. A back-pressure adjusting valve 19 can be located on line 17, between the first expander 9 and the second expander 11. The back-pressure adjusting valve 19 can be used to adjust the intermediate pressure between the first expander 9 and the second expander 11, such as to modify the pressure drops across the two expanders 9 and 11.

According to some embodiments, a bypass line 21 is arranged in parallel to the second expander 11. A bypass valve 23 can be arranged along the bypass line 21. As will be described in more detail herein below, part or the entire working fluid flow from the first expander can be diverted along the bypass line 21, rather than being expanded in the second expander 11.

The second expander 1 is in fluid communication with the hot side of a heat recuperator 25, the output whereof is in fluid communication with a cooler or condenser 29. The cooler 29 is in heat exchange relationship with a cooling fluid, e.g. air or water, as shown schematically at 31, to remove heat from the working fluid flowing through the cooler 29.

The working fluid circulating in the bottom, low-temperature thermodynamic system 2 is pumped or compressed from the low pressure side 2B to the high pressure side 2A by means of a pressure boosting device 33. The device 33 can be a pump, e.g. a turbo-pump or a compressor, e.g. a turbo-compressor. The pump or compressor 33 can be drivingly connected to an output shaft 9A of the first expander 9, such that mechanical power generated by the expansion of the working fluid in the first expander 9 is used to rotate the pump or compressor 33.

In the exemplary embodiment illustrated in the drawings, the low pressure side 2B of the low-temperature thermodynamic system is the portion of circuit located between the discharge side of the second expander 11 and the suction side of the pump or compressor 33. The high-pressure side 2A of the low-temperature thermodynamic system 2 is the portion of circuit located between the delivery side of the pump or compressor 33 and the inlet of the first expander 9.

According to some embodiments, a load 35 can be drivingly connected to an output driveshaft 11A of the second expander 11 and driven into rotation by mechanical power generated by the expansion of the working fluid in the second expander 11. In some embodiments the load can be comprised of an electric generator 37. The electric generator 37 can be electrically connected to a machine, device or apparatus to be electrically powered, or to an electric power distribution grid G, as schematically shown in FIG. 1. In some embodiments, a variable frequency driver 39 can be arranged between the electric generator 37 and the electric power distribution grid (1 or a machine powered by the electric generator 37.

A gearbox 41, a variable speed mechanical coupling, or any other speed manipulation device can be arranged between the output driveshaft 11A of the second expander 11 and the electric generator 37.

The system of FIG. 1 operates as follows. Waste heat from the top, high-temperature thermodynamic system 1 is transferred, through waste heat recovery exchanger 7, to the pressurized working fluid flowing therethrough, for instance carbon dioxide. The hot, pressurized working fluid flows through line 13 and valve 15 and partially expands in the first expander 9. Valve 19 on line 17 can be adjusted to set the required back pressure at the outside of the first expander 9, i.e. the intermediate pressure between the first expander 9 and the second, expander 11. The pressure drop of the working fluid through the first expander 9 from the first pressure in the high pressure side of system 2 to the intermediate pressure generates mechanical power that drives the pump or compressor 33.

Partly expanded working fluid exiting the first expander 9 flows through the second expander 11 and expands from the intermediate pressure to the low pressure of the low pressure side of power system 2. The pressure drop generates mechanical power which is converted into electric power by generator 37.

Exhausted working fluid from the second expander 11 flows through line 24, recuperator 25 and cooler 29. In the recuperator 25 the exhausted working fluid is in thermal exchange relationship with cold, pressurized fluid delivered by pump or compressor 33, such that residual heat contained in the exhausted working fluid can be recovered. The exhausted working fluid exiting the recuperator 25 is further cooled and/or condensed in cooler 29 by heat exchange with the cooling medium 31 and sucked along line 30 by the pump or compressor 33. The cold, pressurized working fluid delivered by the pump or compressor 33 flows through line 34, the cold side of recuperator 25 and returns through line 36 to the waste heat recovery exchanger 7, where the working fluid is heated and vaporized by the recovered waste heat.

At least part of the working fluid in the circuit of the bottom, low-temperature thermodynamic circuit can be in super-critical conditions. In particular, supercritical $CO_2$ can be present in the high-pressure side of the circuit.

Under normal steady-state conditions the bypass valve 23 can be closed, such that the entire working fluid flow expands sequentially through the first expander 9 and the second expander 11. If so required, under some operating conditions part or the entire working fluid flow can be diverted through bypass line 21 and bypass valve 23. This may be the case for instance when the power system 2 is first started and no power is available to drive the load 35, such that the entire pressure drop is exploited to initiate pumping or compressing of the working fluid through pump or compressor 33.

The back-pressure adjusting valve 19 can be used to modify the intermediate pressure between the first expander 9 and the second expander 11, to modulate the amount of mechanical power available on output shaft 9A of the first expander 9 and on the output driveshaft 11A of the second expander 11.

Figure 2:
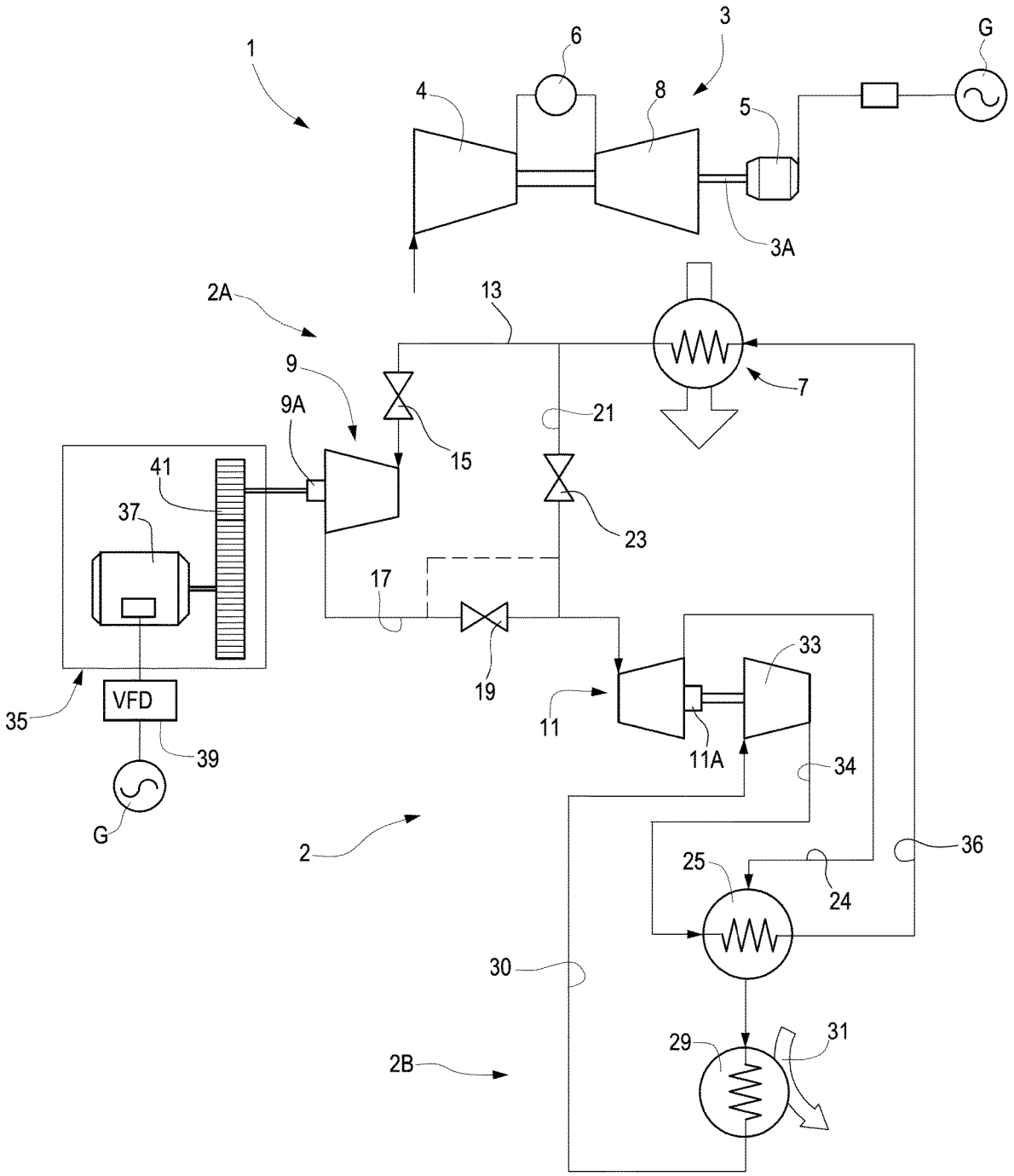
FIG. 2 illustrates a schematic of a further embodiment of a waste heat recovery system according to the present disclosure.

FIG. 2 illustrates a further exemplary embodiment of the power system according to the present disclosure. The same reference numbers are used to designate the same or similar parts or components as shown in FIG. 1. The combined power conversion system of FIG. 2 includes again a top, high-temperature thermodynamic system 1 and a bottom, low-temperature thermodynamic system 2. The top, high-temperature thermodynamic system can be comprised of a gas turbine engine 3 and an electric generator 5 driven by mechanical power generated by the gas turbine engine 3 and available on the output driveshaft 3A of the latter.

The bottom, low-temperature thermodynamic system 2 comprises a working fluid circuit with a high pressure side 2A and a low pressure side 2B, a waste heat recovery exchanger 7, a first expander 9 and a second expander 11, arranged in series, between the high pressure side 2A and the low pressure side 2B.

In FIG. 2 the first expander 9 is connected to the output of the waste heat recovery exchanger 7 through a line 13 and a first valve 15. A line 17 connects the first expander 9 to the second, downstream expander 11. A back-pressure adjusting valve 19 can be located on line 17, between the first expander 9 and the second expander 11. A bypass line 21 is arranged in parallel to the first expander 9. A bypass valve 23 can be arranged along the bypass line 21.

The second expander 11 is in fluid communication with the hot side of a heat recuperator 25, the output whereof is in fluid communication with a cooler or condenser 29. The cooler 29 is in heat exchange relationship with a cooling fluid, e.g. air or water, as shown schematically at 31, to remove heat from the working fluid flowing through the cooler 29.

The working fluid circulating in the circuit bottom, low-temperature thermodynamic system 2, e.g. carbon dioxide, is pumped or compressed from the low pressure side 2B to the high pressure side 2A by means of a pump or compressor 33. In the embodiment of FIG. 2, differently from the embodiment of FIG. 1, the pump or compressor 33 is drivingly connected to an output shaft 11A of the second expander 11, such that mechanical power generated by the expansion of the working fluid in the second expander 11 is used to rotate the pump or compressor 33.

A load 35 can be drivingly connected to an output driveshaft 9A of the first expander 9 and rotated by mechanical power generated by the expansion of the working fluid in the first expander 9. In the embodiment shown in FIG. 2, the load 35 comprises an electric generator 37 connected through a variable frequency driver 39 to an electric power distribution grid G. A gearbox 41 can be arranged between the output driveshaft 9A of the first expander 9 and the electric generator 37.

The system of FIG. 2 operates as follows. Waste heat from the top, high-temperature thermodynamic system 1 is transferred, through waste heat recovery exchanger 7, to the pressurized working fluid flowing therethrough, for instance carbon dioxide in supercritical condition. The hot, pressurized working fluid flows through line 13 and valve 15 and partially expands in the first expander 9. Valve 19 on line 17 can be adjusted to set the required back-pressure at the outlet of the first expander 9, i.e. the intermediate pressure between the first expander 9 and the second expander 11. The pressure drop of the working fluid through the first expander 9 from the first pressure to the intermediate pressure generates mechanical power that is converted into electric power by electric generator 37.

Partly expanded working fluid exiting the first expander 9 flows through the second expander 11 and expands from the intermediate pressure to the low pressure of the low pressure side of power system 2. The pressure drop generates mechanical power which drives the pump or compressor 33.

Exhausted working fluid from the second expander 11 flows through line 24, recuperator 25 and cooler 29. In the recuperator 25 the exhausted working fluid is in thermal exchange relationship with cold, pressurized fluid delivered by pump or compressor 33, such that residual heat contained in the exhausted, low-pressure working fluid can be recovered. The exhausted working fluid exiting the recuperator 25 is further cooled and/or condensed in cooler 29 by heat exchange with a cooling medium 31 and sucked along line 30 by the pump or compressor 33. The cold, pressurized working fluid delivered by the pump or compressor 33 flows through line 34 and the cold side of recuperator 25 and returns through line 36 to the waste heat recovery exchanger 7, where it is heated and vaporized by the recovered waste heat.

Under normal steady-state conditions the bypass valve 23 can be closed, such that the entire working fluid flow expands sequentially through the first expander 9 and the second expander 11. If so required, part of the working fluid flow can be diverted through bypass line 21 and bypass valve 23. This may occur for instance when the power system 2 is first started and no power is available to drive the load 35, such that the entire pressure drop is exploited to initiate pumping or compressing the working fluid through pump or compressor 33.

The back-pressure adjusting valve 19 can be used to adjust the intermediate pressure between the first expander 9 and the second expander 11, to modulate the amount of mechanical power available on output driveshaft 9A of the first expander 9 and on the output driveshaft 11A of the second expander 11.

A particularly simple and efficient power conversion system is thus obtained, which efficiently generates useful mechanical power from waste heat, for instance. Directly driving the pump or compressor by means of one of the expanders reduces the power conversion steps and the number of electric machines in the system, improving the overall efficiency and reducing the costs.

While the disclosed embodiments of the subject matter described herein have been shown in the drawings and fully described above with particularity and detail in connection with several exemplary embodiments, it will be apparent to those of ordinary skill in the art that many modifications, changes, and omissions are possible without materially departing from the novel teachings, the principles and concepts set forth herein, and advantages of the subject matter recited in the appended claims. Hence, the proper scope of the disclosed innovations should be determined only by the broadest interpretation of the appended claims so as to encompass all such modifications, changes, and omissions. In addition, the order or sequence of any process or method steps may be varied or re-sequenced according to alternative embodiments.

This written description uses examples to disclose the invention, including the preferred embodiments, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A power system comprising:

a working fluid circuit having a high pressure side and a low pressure side and configured to flow a working fluid therethrough;

a heater configured to circulate the working fluid in heat exchange relationship with a hot fluid to vaporize the working fluid;

serially arranged first expander and second expander fluidly coupled to the working fluid circuit and disposed between the high pressure side and the low pressure side thereof, configured to expand working fluid flowing therethrough and generating mechanical power therewith;

a driveshaft drivingly coupled to one of said first expander and second expander, and configured to drive a device with mechanical power produced by said expander;

a pump or compressor fluidly coupled to the working fluid circuit between the low pressure side and the high pressure side thereof, configured to raise the pressure of the working fluid in the working fluid circuit, and drivingly coupled to the other of said first expander and second expander and being powered thereby;

a cooler arranged and configured to remove heat from the working fluid in the low pressure side of the working fluid circuit; and a regulating valve defining an input and an output, wherein the input of the regulating valve is directly connected to the first expander and the output of the regulating valve is directly connected to the second expander.

2. The system of claim 1, wherein the device drivingly coupled to the driveshaft is an electric generator, configured to convert mechanical power produced by the expander, whereto the driveshaft is connected, into electric power.

3. The system of claim 1, wherein the regulating valve is configured to control a back pressure of the first expander.

4. The system of claim 1, wherein the first expander and the second expander are configured and arranged such that a mass flow of working fluid flowing through the first expander also flows through the second expander.

5. The system of claim 1, wherein at least one of said first expander and second expander is provided with a by-pass valve, configured and controlled to cause at least part of the working fluid circulating in the working fluid system to by-pass said expander.

6. The system of claim 5, wherein the by-pass valve is arranged in parallel to the one of said first expander and second expander, and the driveshaft is drivingly connected to the one of said first expander and second expander.

7. The system of claim 1, wherein the first expander is disposed between a waste heat recovery heat exchanger and the second expander, and the second expander is arranged between the first expander and the cooler; and wherein the driveshaft is drivingly coupled to the second expander.

8. The system of claim 1, wherein the first expander is disposed between a waste heat recovery heat exchanger and the second expander, and the second expander is arranged between the first expander and the cooler; and wherein the driveshaft is drivingly coupled to the first expander.

9. The system of claim 1, wherein the working fluid comprises carbon dioxide, and wherein at least a portion of the working fluid circuit contains carbon dioxide in a supercritical state.

10. A method for producing useful power from heat provided by a heat source, comprising the following steps:

circulating a working fluid flow by means of a pump or compressor through a working fluid circuit having a high pressure side and a low pressure side, wherein the high pressure side is in heat exchange relationship with the heat source and the low pressure side is in heat exchange relationship with a cooler;

transferring thermal energy from the heat source to the working fluid;

expanding the working fluid flow through a first expander from a high pressure to an intermediate pressure, converting a first pressure drop to mechanical power, and expanding the working fluid flow through a second expander from the intermediate pressure to a low pressure, converting a second pressure drop to mechanical power, wherein the first expander and the second expander are arranged in series to one another and fluidly coupled to the working fluid circuit, between the high pressure side and the low pressure side;

adjusting, via a regulating valve defining an input and an output, the intermediate pressure to regulate the pressure drop across the first expander and the pressure drop across the second expander, wherein the input of the regulating valve is directly connected to the first expander and the output of the regulating valve is directly connected to the second expander;

removing residual, low-temperature heat from the working fluid flow through the cooler;

driving a device with mechanical power generated by one of the first expander and second expander and driving the pump or compressor with mechanical power generated by the other of said first expander and second expander.

11. The method of claim 10, wherein the driven device is drivingly connected to the first expander and the pump or compressor is drivingly connected to the second expander.

12. The method of claim 10, wherein the driven device is connected to the second expander and the pump or compressor is drivingly connected to the first expander.

13. The method of claim 10, wherein the driven device is an electric generator, and further comprising the step of converting mechanical power generated by the one of the first expander and the second expander drivingly connected to the electric generator into electric power by means of said electric generator.

* * * * *